US006855679B2

(12) United States Patent
Renfrow

(10) Patent No.: US 6,855,679 B2
(45) Date of Patent: Feb. 15, 2005

(54) DETERGENT COMPOSITION AND METHOD OF USING SAME

(76) Inventor: Lance L. Renfrow, 47 N. Ski Ct., Gilbert, AZ (US) 85233

( * ) Notice: Subject to any disclaimer, the term of this patent is extended or adjusted under 35 U.S.C. 154(b) by 136 days.

(21) Appl. No.: 10/393,741

(22) Filed: Mar. 21, 2003

(65) Prior Publication Data

US 2003/0232736 A1 Dec. 18, 2003

Related U.S. Application Data

(63) Continuation-in-part of application No. 09/886,950, filed on Jun. 19, 2001, now Pat. No. 6,555,511.
(60) Provisional application No. 60/212,699, filed on Jun. 19, 2000.

(51) Int. Cl.[7] ..... C11D 17/00
(52) U.S. Cl. ..... 510/218; 510/426; 510/490; 510/499; 510/510; 134/47
(58) Field of Search ..... 510/218, 426, 510/490, 499, 510; 134/47

(56) References Cited

U.S. PATENT DOCUMENTS 4,383,929 A * 5/1983 Bertocchio et al. ..... 252/8.05
6,281,178 B1 * 8/2001 Ryklin et al. ..... 510/181
6,300,296 B1 * 10/2001 Bergeron et al. ..... 510/127
6,599,370 B2 * 7/2003 Skee ..... 134/3
6,740,626 B2 * 5/2004 Neumiller ..... 510/109

* cited by examiner

*Primary Examiner*—Necholus Ogden
(74) *Attorney, Agent, or Firm*—The Weintraub Group, PLC

(57) ABSTRACT

A detergent blend is prepared by admixing together a fluorinated surfactant and an amphoteric-based sultaine surfactant hydrotrope. This blend can then be formulated into a detergent concentrate which includes a caustic compound, a chelant, a descaler, and other adjuvants to enable the concentrate to be diluted into a use solution for use in either an acid or base environment. The use solution prepared from the detergent blend is particularly useful in cleaning draft beer lines, dairy lines, and the like.

10 Claims, No Drawings

DETERGENT COMPOSITION AND METHOD OF USING SAME

CROSS-REFERENCE TO RELATED APPLICATIONS

This application is a continuation-in-part application of co-pending U.S. patent application Ser. No. 09/886,950, filed Jun. 19, 2001, now U.S. Pat. No. 6,555,511 which claims priority of Provisional Application Ser. No. 60/212,699, filed Jun. 19, 2000 for "DETERGENT COMPOSITIONS AND METHODS," the disclosures of which are hereby incorporated by reference.

BACKGROUND OF THE INVENTION

1. Field of the Invention

The present invention concerns detergent compositions and methods of use therefor. More particularly, the present invention concerns detergent concentrates and use solutions prepared therefrom. Even more particularly, the present invention concerns detergent concentrates and use solutions prepared therefrom and methods of use therefor.

2. Prior Art

In U.S. patent application Publication No. 20020037821, published Mar. 28, 2002 for "Detergent Compositions and Methods," the disclosure of which is hereby incorporated by reference, there is disclosed a detergent composition which comprises a mixture or blend of a high cloud point and low cloud point surfactant. This blend has particular utility in cleaning brewery and food processing apparatus. According to the invention defined therewithin, the use solution mixture or blend has low surface tension, is low foaming, and is compatible in both caustic and acid environments. Further, according to this patent publication, the blend of surfactants contains sultaine amphoteric surfactant as one component which hydrotropes the blend, itself, into solution to form an aqueous use solution thereof.

The present invention, as will subsequently be detailed hereinafter, provides an improved formulation over that of the above-referred to prior art in that a single surfactant is ultimately hydrotroped into the use solution and as a consequence thereof, affords a use solution with a much lower surface tension, lower foam and enhanced rinseability estimated to be at least five-fold over the prior art. Necessarily, then, less material is used providing a major cost savings and a much cleaner system.

SUMMARY OF THE INVENTION

In accordance herewith, there is provided a detergent blend which, generally, comprises:

(a) a fluorinated surfactant, and (b) an amphoteric-based sultaine surfactant hydrotrope.

This detergent blend is employed in a detergent concentrate from which is prepared a use solution compatible in both a caustic and an acid environment and which is useful for cleaning protein deposits in brewery apparatus as well as dairy and other related food processing apparatus.

The present invention shows efficacy in both caustic and acid environments and is particularly adapted for utilization in the removal of protein deposits in brewery apparatus, dairy processing and related food apparatus.

For a more complete understanding of the present invention reference is made to the following detailed description and accompanying examples.

DESCRIPTION OF THE PREFERRED EMBODIMENT

As hereinabove note and in accordance herewith, there is provided a detergent blend which, generally, comprises:

(a) a fluorinated surfactant, and (b) an amphoteric-based sultaine surfactant hydrotrope.

This detergent blend is employed in a detergent concentrate from which is prepared a use solution compatible in both a caustic and an acid environment and which is useful for cleaning protein deposits in brewery apparatus as well as dairy and other related food processing apparatus.

With more particularity and as noted, the surfactant used in the blend, is a fluorinated surfactant. Such fluorinated surfactants are anionic surfactants having one or more fluorine atoms incorporated thereinto either into the backbone of the surfactant or as a branched substituent.

The second compound or component of the blend is an amphoteric hydrotrope. Preferably, this hydrotrope is a sultaine-based hydrotrope and, more preferably, an alkyl ether hydroxy propyl sultaine. Such a hydrotropic compound is sold commercially under the name Miratine ASC. Generally, the hydrotrope will comprise from about 95.0% to about 99.5%, by weight, based upon the total weight of the detergent blend and, preferably, from about 96.0% to about 98.0%, by weight of the total weight of the detergent blend.

Among the useful fluorinated surfactants are those which correspond to the formula:

$$CF_3—CF_2(CF_2CF_2)_n(CH_2)_yX$$

Wherein n is an integer ranging from 1 to about 9, y is an integer ranging from 0 to about 5 and X is an anionic radical, which may be selected from the group consisting of sulfate, sulfonate, phosphate, phosphonate, ammonium, thiosulfate, thiosulfonate, and the like, as well as mixtures thereof.

A particularly preferred surfactant is that sold by Innovative Chemical Technologies, Inc. under the trademark FLEXIWET NF. Flexiwet NF is described as a perfluorinated anionic functional compound comprising about a 50:50 weight mixture blend of a linear $C_4$ to $C_{14}$ perfluoro alkyl ethyl phosphonate acid and a perfluoro alkyl ethyl phosphonic acid surfactant.

The fluorinated surfactant will generally comprise from about 0.5% to about 5.0% by weight of the blend and, preferably, from about 2.0% to about 4.0% by weight of the blend.

The detergent blend hereof is used to prepare a detergent concentrate therefrom. In manufacturing the concentrate, the surfactant or detergent blend is present in an amount ranging from about 0.5% to about 1.0%, by weight, based upon the total weight of the concentrate.

The concentrate, preferably, comprises an aqueous solution of a base or caustic material, a chelant, a dispersant, a scale inhibitor, the detergent blend and water.

The caustic or base is, preferably, an alkali metal hydroxide, such as, sodium hydroxide, potassium hydroxide, and the like as well as mixtures thereof. Other compounds useful as a base include, for example, alkali metal carbonates, alkali metal bicarbonates and the like. Preferably, though, the caustic or base material is sodium hydroxide because of its superior properties as a soap. Sodium hydroxide is typically employed as a 50% aqueous solution thereof Generally, the caustic material, as the 50% aqueous solution, comprises from about 90% up to about 95% by weight of the total weight of the concentrate.

Herein, and preferably, from about 1% to about 10% of the 50% aqueous caustic solution is used in the final formulation or use solution.

As noted, the concentrate further includes a least one chelant. Because of its non-corrosive properties the preferred chelants are the alkali metal salts of gluconic acid including sodium gluconate, sodium glucoheptonate, 1-methyl glucoside and the like. Mixtures of chelants can be used.

Generally, the chelant will be used in an amount ranging from about 1.0% to about 5.0%, by weight, and based on the total weight of the concentrate and, preferably, from about 1% to about 3.5% weight percent. In preparing the concentrate, the preferred chelant is sodium gluconate.

As noted, the concentrate further includes a scale inhibitor as well as a dispersant. Any of the well-known inhibitors and dispersants may be use so long as they are chemically compatible with the detergent blend and the base material.

Useful compounds include, for example, DEQUEST 2000, which functions as a buffer and scale inhibitor, which is aminotrismethylene phosphonic acid (ATMP) and the like. Generally, this adjuvant will comprise from about 1.0% to about 2.25%, by weight, of the concentrate.

The balance of the concentrate is water.

The concentrate is prepared by admixing the components together at ambient conditions. The concentrate is a homogeneous solution and is storage stable.

In preparing a use solution or final formulation from the concentrate, the concentrate is admixed with water at ambient conditions with stirring. As noted above, the use solution will generally contain or be about a 1% to about a 10%, by weight, the 50% aqueous caustic solution, based on the caustic in the concentrate.

In other words, the concentrate is diluted with water to achieve a presence therein of about a 1% to about a 10%, by weight, amount of the 50% caustic solution. Thus, the use solution will contain from about 0.5% by weight to about 5% by weight of caustic.

The use solution is deployed by pumping it through the fluid delivery lines, such as a draft line, milk line, etc. The present detergent composition has exhibited superior capabilities in cleaning draft beer delivery lines due to its low surface tension.

Generally, such lines will be at a temperature from about 50° F. to slightly about 200° F. The present composition is effective over this range.

Usually, the composition is pumped through the lines for about 2 to about 30 minutes. Thereafter, the line is rinsed at ambient temperatures with water.

As noted, the present detergent blend is a low foam composition that is water soluble and is useful in both acid and base environments. The fluorinated surfactant lowers the surface tension to a degree that there is less use solution consumption and faster cleaning cycle times.

For a more complete understanding of the present invention, references made to the following non-limiting illustrative examples. In the examples, all parts are by weight absent indications to the contrary.

EXAMPLE 1

A surfactant blend in accordance herewith is prepared by the following procedure:

Into a suitable vessel equipped with stirring means was added the following, at room temperature:

| Ingredient | Amount (pbw) |
|---|---|
| Miratine ASC Hydrotrope[1] | 96.0 |
| Fluorinated surfactant | 4.0 |
| | 100.0 |

[1]Flexiwet NF

EXAMPLE II

This example illustrates the preparation of a detergent concentrate in accordance with the present invention.

Into a suitable vessel equipped with a stirrer is added with stirring:

| Ingredient | Amount (pbw) |
|---|---|
| Surfactant Blend[1] | 0.50 |
| Caustic Soda, as a 50% aqueous sol'n | 90.00 |
| Sodium Gluconate, as a 60% aqueous sol'n | 3.25 |
| Dequest 2000, as a buffer | 2.25 |
| Water | 4.00 |
| | 100.0 |

[1]a 44:1 part blend of Mirataine ASC and Flexiwet NF
This concentrate is useful in brewery cleaning.

Having, thus, described the invention what is claimed is:

1. A detergent blend which comprises:

(a) a fluorinated surfactant comprising a 50:50 weight mixture blend of a $C_4$ to $C_{14}$ perfluoro alkyl ethyl phosphonated acid and a perfluoro alkyl ethyl phosphoneic acid; and (b) an amphoteric-based sultaine surfactant hydrotrope.

2. The detergent blend of claim 1 which further comprises a second surfactant, the surfactant being an anionic surfactant.

3. A detergent concentrate comprising:

from about 0.5% to about 1.0%, by weight, of the blend of claim 1.

4. The concentrate of claim 3 which further comprises:

an aqueous caustic material, a chelant, a dispersant, a scale inhibitor, a buffer, and water.

5. The concentrate of claim 4 wherein the caustic material is a 50% aqueous solution of caustic soda.

6. A use solution comprising:

water and the concentrate of claim 3.

7. The use solution of claim 6 wherein:

the use solution contains from about 1% to about 10%, by weight, of a 50% aqueous caustic solution.

8. A method of cleaning a fluid delivery line in a brewery by pumping through the line a use solution comprising:

(a) a fluorinated surfactant;

(b) an amphoteric-based sultaine surfactant hydrotrope; and (c) water.

9. The method of claim 8 wherein:

pumping is done at a temperature ranging from about 50° F. to about 200° F.

10. The method of claim 9 which further comprises:

rinsing the line at ambient temperatures after pumping the use solution therethrough.

* * * * *